United States Patent [19]

Piffath

[11] 4,419,069

[45] Dec. 6, 1983

[54] FLAME IGNITER

[75] Inventor: Rodney S. Piffath, Sunland, Calif.

[73] Assignee: Firelite Products Inc., Alhambra, Calif.

[21] Appl. No.: 174,273

[22] Filed: Jul. 31, 1980

[51] Int. Cl.[3] ..... F23Q 2/16

[52] U.S. Cl. ..... 431/89; 431/277; 431/344

[58] Field of Search ..... 431/89, 142, 143, 150, 431/254, 276, 277, 344

[56] References Cited

U.S. PATENT DOCUMENTS

| | | | |
|---|---|---|---|
| 3,471,246 | 10/1969 | Piffath et al. | 431/150 |
| 3,523,006 | 8/1970 | Piffath et al. | 431/277 |
| 3,594,108 | 11/1969 | Villarreal-Cueva | 431/277 |
| 4,295,819 | 10/1981 | Sugiyama | 431/143 |

FOREIGN PATENT DOCUMENTS

| | | | |
|---|---|---|---|
| 1273045 | 8/1961 | France | 431/143 |

*Primary Examiner*—Carroll B. Dority, Jr.
*Attorney, Agent, or Firm*—George W. Finch

[57] ABSTRACT

A flame igniter for lighting barbecues, gas fireplaces and other devices which tend to flash and therefore require remote ignition. The igniter includes a cylindrical, liquefied gas, fuel reservoir having a plug and valve assembly positioned in one end for filling from commercial containers having various nozzle designs and also for emergency pressure release, and a similar plug in the opposite end, a portion of which forms a valve seat against which a metal valve needle can be actuated to release and regulate fuel into a long thin burner tube, which exits adjacent a removable modular igniter assembly with a confortably operating spark wheel. The burner tube is connected to the source of liquefied gas by the valve and a relatively long tube beneath the valve. The tube has a predetermined volume for liquid fuel so that tilting the igniter from its normal upright position, when the flame is ignited, to an inverted position feeds liquid fuel to the valve for a predetermined time determined by the volume so that the quality and size of the flame does not vary appreciably for the time period required for operation of the igniter.

30 Claims, 5 Drawing Figures

FLAME IGNITER

BACKGROUND OF THE INVENTION

Flame igniters such as those useful in lighting combustible materials wherein the flame of the igniter must be pointed in other than an upward direction are difficult to design so that the size and quality of the flame does not change as the igniter is tilted from vertical. Features of such devices are taught in WAKAMATSU, U.S. Pat. No. 3,592,579; PIFFATH, et al, U.S. Pat. No. 3,740,183 and ROSENTHAL, U.S. Pat. No. 3,938,947. These devices, as well as commercially available igniters, which utilize butane gas in a compressed liquid form, require adapters so that the fuel from the containers of various suppliers can be transferred under pressure thereinto. A solution to the filling problem also has been to make a throwaway unit with no provision to add fuel once the igniter has left its place of manufacture. Available igniters can become extremely dangerous in the event they are exposed to high temperature conditions, such as when they are thrown in a fire. This causes the internal pressure to build until the case bursts, spewing flame and shrapnel. Various pressure release devices are available. However, most igniters must sell at low competitive prices and the available pressure release devices are too expensive to incorporate. Such igniters also suffer because it is difficult to manufacture an on/off type, adjustable regulator valve which is capable of providing a relatively constant flame size no matter how the orientation of the igniter is changed. This is especially important when devices such as pipes, gas barbecues, gas fireplaces, furnaces or other devices requiring other than a vertical flame for ignition are to be ignited. In the latter cases, it is also desired that the igniter be of sufficient length that the user thereof can be positioned to avoid the sudden flash with which some such devices ignite. Known on/off regulator designs tend to regulate and turn on and off with different components so that improper assembly, misuse or breakage can result in a device that will retain butane but will not regulate it, resulting in a dangerous situation when the gas finally is released and ignited.

Many igniters which have spark wheels have been provided with remote actuation devices which prevent abrasion to the thumb when actuating the spark wheel, such as levers, ratchets and the like. However, for simple, trouble-free operation at a reasonable cost, it is desirable that the spark wheel be thumb actuated directly. Smooth flanges adjacent to and integral with the frictionized portion of the spark wheel reduce thumb abrasion but such are relatively costly to manufacture.

BRIEF DESCRIPTION OF THE PRESENT INVENTION

The present flame igniter includes a body constructed in part from an elongated metal tube which can be of any desired length, the shorter lengths being used for applications such as pipe lighters, and the longer lengths being used in applications where the danger of ignition flash is expected. The tube is blocked at its bottom end by a plug of predetermined resilience through which a fill valve is positioned. Nylon is suitable plug material. The plug and a stem extending from the fill valve are shaped to be engaged and be operated by the more common nozzles used commercially available liquefied butane. The plug is retained in the tube in a sealed condition, yet it is designed to release extreme pressure within the tube without becoming a projectile.

The upper end of the tube is blocked by a plug of material similar to the above mentioned plug. It has a on/off regulator valve assembly including a valve seat with adjacent threads machined in the plug. The threads engage a metal valve needle and are capable of holding the needle against the seat to block flow therepast. A lever is provided for rotation of the valve needle to open a passageway for the fuel allowing liquid butane to gasify and flow through a connected, relatively long burner tube. The gasification of the liquid butane in the burner tube keeps the tube cool. The butane gas exits the burner tube adjacent the spark path of a modular spark wheel and flint assembly for ignition. The liquid butane is fed to the valve assembly by means of a long pickup tube which extends from the upper plug to adjacent the lower plug. Normally, when to be ignited, the igniter is vertically positioned with the burner tube exit pointed upwardly, the valve opened and the spark wheel spun to ignite the gas exiting the burner tube. Since the flow characteristics of gas are much quicker than liquid, very shortly after the valve assembly is opened, liquid fuel is present at the valve assembly for constant metering to produce a steady ignited flame. Thereafter, should the igniter be tilted from the vertical position, a volume of liquid fuel is present in the elongated pickup tube so that dependent upon the volume of the tube and the desired height of the flame, a predetermined time is established during which the flame is relatively constant both in height and quality. This allows convenient ignition of pipes, barbecues, furnaces and other devices. The length of the entire igniter assembly, which can be constructed as long as needed, enables the user to be remotely located from the point of ignition for the igniter. Once the igniter has performed its function, the valve assembly is closed, extinguishing the flame.

The upper plug, like the lower plug, can be equipped with means for releasing pressure should the contained fuel be accidently heated to an extent that there is danger of bursting the body. Therefore, the igniter has redundant safety means for preventing catastrophic failure.

Not only does the present igniter provide a high quality and constant flame in many orientations, it can be constructed from relatively economical materials on a production line basis at very competitive prices, can be adapted for flame times as desired, and includes an economical design to construct a comfortable spark wheel. The spark wheel is positioned between adjacent thumb supporting discs which can be constructed from more economical materials than the friction wheel, and yet provide a broad base for actuation by a thumb without excessive abrasion thereto. The entire device can be finished to provide a pleasing appearance.

It is therefore an object to the present invention to provide a flame igniter which produces a constant quality flame for a predetermined time no matter what the orientation of the igniter.

Another object is to provide means for safely lighting devices such as gas barbecues, furnaces, gas fireplaces and other devices which have a tendency to flash upon ignition by allowing the user to be remotely located away from the flash.

Another object is to provide an economical flame lighter whose flame can be regulated easily without resort to expensive matched valve seats or micro-cellular dampening pads.

Another object is to provide a liquefied gas flame igniter which can release safely the liquefied gas when abused.

Another object is to provide a safe flame igniter design which is adaptable to many different sizes and purposes including small pocket cigarette lighters and large capacity, long furnace ignitors.

Another object is to provide a liquefied gas lighter which can be filled from many different types of commercially available liquefied gas containers.

Another object is to provide a liquefied gas, flame ignitor whose control point is remote from the flame and which does not require continuous manual actuation.

Another object is to provide a flame lighter whose flint and spark wheel ignition system is of modular design so it can be separated from the igniter for replacement of the flint, repair or total replacement.

Another object of the present igniter is to provide a safe dependable tubular gas resevoir which requires no welding, soldering, compounding, magnetic or roll compression and which fails safely upon a dangerous increase in internal pressure.

Another object is to provide a flame igniter having a single unit self-seating on/off regulator which can provide board instant control of flame size without the need for a matched valve seat or micro-cellular dampening pads which over a period of use, clog.

Another object is to provide a flame ignitor of such fool proof and simple construction that the heretofore requirements for expensive quality control over numerous components can be reduced greatly.

These and other objects and advantages of the present invention will become apparent to those skilled in the art after considering the following detailed specification in conjunction with the accompanying drawing wherein:

DETAILED DESCRIPTION OF THE SHOWN EMBODIMENTS

Figure 1:
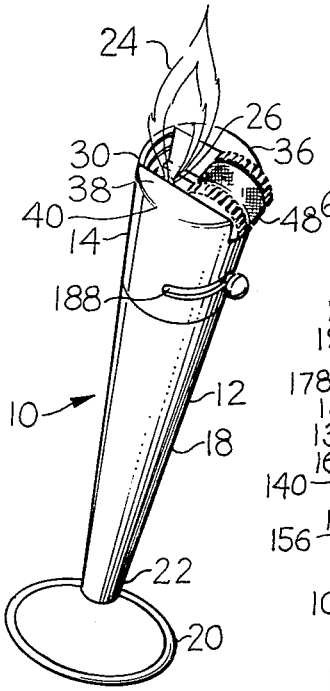
FIG. 1 is perspective view of a flame igniter constructed according to the present invention.

Referring to the drawing more particularly by reference numbers, number 10 in FIG. 1 refers to a flame igniter constructed according to the present invention. The igniter 10 includes a preferably cylindrical, tubular body 12, at the upper end 14 of which is included a cap member 16 shaped to match the contour of the body 12. A typical example is a polished brass cap member and a flat black body. The cap member 16 may be decorated in a contrasting manner to the lower portion 18 of the body 12. A ring 20 is positioned at the lower end 22 of the body 12 to provide handy means for hanging the igniter 10 adjacent the device to be ignited when the igniter 10 is not in use.

Figure 2:
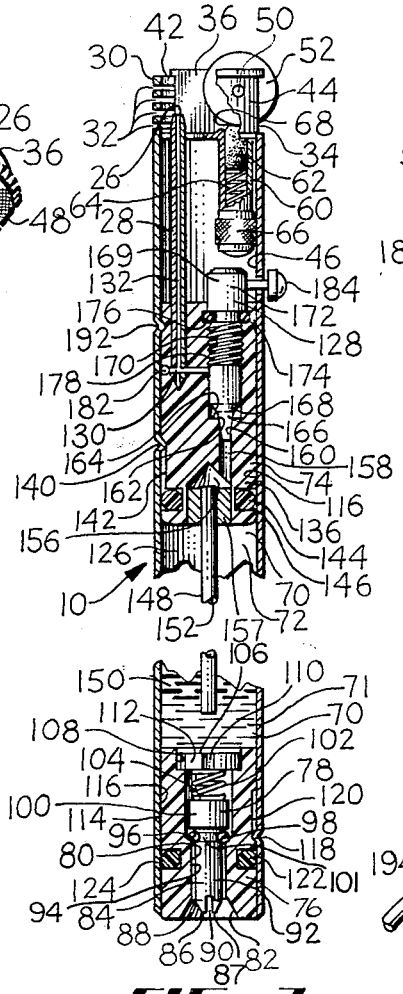
FIG. 2 is a fragmented cross-sectional view of the igniter of FIG. 1 showing its internal details.

When in use the igniter 10 produces a flame 24 of burning gas which extends outwardly from the outlet end 26 of a burner tube 28 (FIG. 2). A venting grille 30, constructed by placing slits 32 in a portion of the upper end 14, is positioned adjacent the outlet end 26 of the burner tube 28 so that oxygen can mix with the gaseous fuel emitting from the burner tube 28 and be ignited by an adjacent ignition assembly 34. The igniter assembly 34 includes a modular case 36 shaped and sized to fit within the upper end 14 and having a flanged top 38 whose flange 40 abuts the upper surface 42 of the upper end 14. The body 36 of the ignition assembly 34 also includes a cylindrical surface 44 sized to frictionally engage the cylindrical inner surface 46 of the upper end 14 so that friction and the flange 40 cause the igniter assembly 34 to remain positioned within the upper end 14 unless forceably lifted away therefrom.

Figure 3:
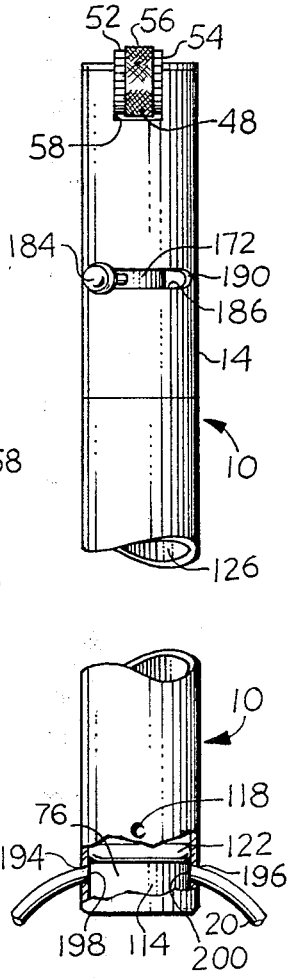
FIG. 3 is a partially cross-sectional, fragmented side view of the present igniter showing the details of its spark wheel and valve actuation means.
Figure 5:
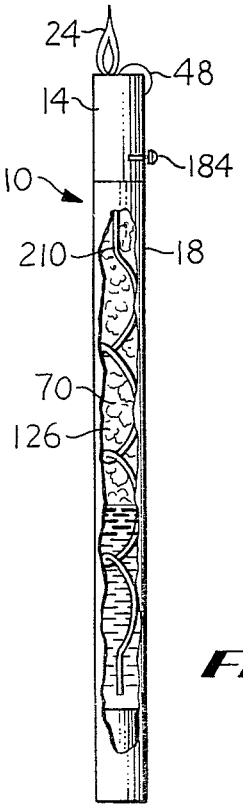
FIG. 5 is a partially cutaway view of a igniter constructed according to the present invention having a modified pickup tube therein for increasing the time that a constant quality flame can be produced.

The ignition assembly 34 also includes a spark wheel 48 which is mounted on a transverse shaft 50 between a pair of thumb protecting discs 52 and 54 which effectively widen the outer cylindrical surface 56 thereof to increase comfort during manual rotation of the spark wheel 48. As can be seen in FIGS. 1, 2 and 3, the spark wheel 48 with its two discs 52 and 54 extend above the flanged top 38 of the modular case 36 and sidewardly through a cutout 58 in the upper end 14 provided therefore so that a predetermined portion of the spark wheel 48 is available for manual rotation.

As shown in FIG. 2, the modular case 36 also includes a downwardly extending, hollow cylindrical portion 60 of reduced diameter in which a flint 62 is positioned and forced upwardly against the spark wheel 48 by means of a compressed spring 64. The spring 64 is held in a compressed position by a cap member 66 threadably connected to the cylindrical portion 60. The tangent to the point of contact 68 between the outer cylindrical surface 56 of the spark wheel 48 and the flint 62 is aimed at the outlet end 26 of the burner tube 28 so that gas exiting the burner tube 28 can be ignited by manual rotation of the spark wheel 48.

Fuel 70, in both liquid 71 and gaseous 72 form is stored within the lower portion 18 between upper and lower plugs 74 and 76 preferably constructed from nylon or other suitable plastic material having a mechanical "memory." The lower plug 76 has a filler valve assembly 78 placed in a multidiameter bore 80 positioned centrally therethrough. The bore 80 has a frustroconical lower end 82 for contact with filler nozzles of various configurations. A nipple member 84 extends into the area encircled by the frustroconical surface 82. The member 84 includes an end 86 having a radial end surface 87, a tapered portion 88 and a transverse slot 90 which allows engagement with and transfer of fuel 70 from a supply nozzle (not shown) through the valve assembly 78 between the cylindrical portion 92 of the nipple and the loose fitting adjacent bore surface 94. An O-ring 96 is supported adjacent an inwardly sloping frustroconical shelf 98 formed in the bore 80 and retained against the shelf 98 by an outwardly flanged collar 100 connected to the cylindrical portion 92 of the nipple 84. The O-ring 96 stays in a groove 101 formed beneath the collar 100. This assembly is normally biased to compress the O-ring 96 into sealing contact with the shelf 98 by means of a compressed spring 102 which bears against the top surface 104 of the collar 100. The O-ring 96, when unstressed, has an outer diameter which is smaller than the diameter of the adjacent portion of the bore 80 so that the fuel 70 can flow past the nipple member 84 when the O-ring 96 is lifted off of the shelf 98, breaking the seal. The spring 102 is retained in position by a disc 106 pressed into a larger diameter portion 108 of the bore 80. Cutouts 110 are provided about the circumference 112 of the disc 106 to allow flow of the fuel 70 therepast.

The lower plug 76 is retained within the lower portion 18 by friction between its outer surface 114 and the inner surface 116 of the lower portion 18 as well as by an indentation 118 in the lower portion 18 adjacent the plug 76. The indentation 118 preferably extends inwardly a distance slightly greater than the depth of a vertically oriented slot 120 in which it sits. This allows extreme overpressure within the lower portion 18, such as might be caused by overheating of the fuel 72 and 74, to force the plug 76 out of the lower portion 18 until an O-ring 122 positioned in a radial groove 124 in the plug 76 below the indentation 118 moves beyond the lower portion 18. The O-ring 122 normally provides a seal which prevents fuel 70 from leaking past the plug 76 and, once uncovered, allows the fuel 70 to gradually leak releasing the dangerous overpressure. Since the fuel 70 used in such igniters 10 commonly is butane and butane dissipates relatively quickly, there is far less danger in releasing the butane than allowing its pressure to build to an explosive level.

Once fuel 70, which is usually in liquid form 71 has flowed past the filler valve assembly 78, it is retained within a storage chamber 126 defined by the inner surface 116 of the lower end 18 and the two plugs 74 and 76. The fuel 70 remains in the chamber 126 until released through an on/off regulator valve assembly 128, a transfer orifice 130, and the inner opening 132 of the burner tube 28. The upper plug 74 is retained at the upper end 134 of the lower portion 18 by friction between the outer cylindrical surface 136 of the plug 74 and the inner cylindrical surface 116 of the lower end 18. In addition to the friction, an indentation 140 and slot 142 similar to indentation 118 and slot 120 are provided to releasably retain the plug 74 within the lower portion 18. Like the lower plug 76, the upper plug 74 can move in response to overpressure within the chamber 126. In this case, however, a plug sealing O-ring 144 positioned in a radial groove 146 in the upper plug 74 and preventing an escape of gas therepast moves upwardly until engaged by the indentation 140 which breaks the seal and allows the fuel 70 to escape. Either construction can be used as well as a third construction to be discussed hereinafter to provide emergency release of the fuel out of the chamber 126 when the gaseous pressure becomes dangerously high. The refill valve assembly 78 makes device 10 having miniature reservoirs 126 practical since refill is quick and easy. Therefore, an adequate but only a harmless amount of fuel 70 need be stored.

Since the igniter 10 is normally lit when in the vertical position shown in FIG. 2, a long feed tube 148 is provided to extend down beneath the liquid-gas interface 150 of the fuel 70. Therefore, liquid fuel 71 flows up through a central opening 152 in the tube 148 from the lower tip 154 thereof to a valving chamber 156 into which the tube 148 is connected by a cylinderical retainer 157. The valving chamber 156 is formed in the plug 74 and has a portion 158 which ends at a frustroconical valve seat 160. The seat 160, as shown, includes surface 162. The surface 162 is shown being engaged by a frustroconical portion 166 of a valve needle 169 which is threadably engaged with a bore 170 in the upper plug 74. The frustroconical surface 162 is formed from the cylindrical portion 158. The wedging action of the portion 166 of the valve needle 169 deforms the nylon material whose memory characteristic retains the frustroconical shape. The needle 169 includes an upper collar 172 which compresses an O-ring 174 against a shelf 176 above the threaded portion 178 of the bore 70 to prevent gas leakage beyond the threaded portion 179 of the needle 169. The above described combined on/off regulator assembly reduces the number of required components to a minimum from the 5 to 10 parts required in prior art devices. The construction shown also eliminates the chance that by improper assembly or through improperly constructed parts, a dangerous device can be produced. In conventional on/off regulators, it is possible to erroneously construct a regulator that operates to retain fuel but provides no regulation so that a large flashing flame which is dangerous and frightening results when the lighter is first used. Due to the simplicity of the present invention, should there be an error in manufacturing, no fuel can be retained or no fuel can be released. So long as the valve needle 169 with its tip portion 166 is present, the device 10 will function safely.

A transfer orifice 130 extends from the bore 170 below the O-ring 174 sidewardly to connect with the central opening 152 of the burner tube 28. The transfer orifice 180 extends beyond the burner tube 28 for ease of manufacture and is suitably plugged thereat by inserting a ball plug 182 therein. Once fuel 70 in liquid form 71 has passed the valve seat 160, it quickly becomes gaseous during its trip up the burner tube 28, thus cooling the tube 28 and assisting in assuring a constant quality flame 24. In addition to the cooling effect of the gasifying fuel, the length of the tube 28 results in the flame 24 being remote from the valve assembly 128 so that constant regulation is assured. Since the needle 169 is constructed from metal and it engages a nylon seat 160, the on/off characteristics thereof are noncritical, yet once a flow of fuel 70 has been started, the flow thereof tends to remain the same, keeping the flame height and quality constant. Of course, should fuel 70 in gaseous form 72 enter the tip 154 of the feeder tube 148, the different flow characteristics thereof will cause the flame 24 to vary. Therefore, the volume of the tube is chosen to provide enough fuel 70 in liquid form 71 so that the flame 24 does not vary over a predetermined time no matter how the igniter 10 is oriented once the flame 24 has been lit with the igniter 10 in a vertical position with its cap 14 on top. The needle valve assembly 128 can be rotated from an off position to an on position regulating the size of the flame by movement via a sidewardly extending knob 184 connected to the collar 172 thereof and extending through a slot 186 in the upper end portion 14. Since the ends 188 and 190 of the slot 186 restrict the rotation of the knob 184, the valve seat 160 can not be overstressed nor can the fuel 70 be released at two great a rate. As can be seen in FIG. 2, another indentation 192 locks the upper portion 14 to the upper plug 74, which fixes the respective positions of the slot ends 188 and 190 and the knob 184. The indentation 192 also causes the upper portion 14 to move upwardly with the upper plug 74 in response to extreme overpressure. Although sufficient friction is present between the needle 169 and the plug 74, a detent (not shown) can be provided in the slot 186 to further restrict rotation of the needle 169 and assure that the needle 169 is not inadvertantly rotated to an open position.

As shown in FIG. 3, the ring 20 extends through two holes 194 and 196 in the lower portion 18. The ring 20 can be made from springy material so that its ends 198 and 200 are biased to engage the outer surface 114 of the lower plug 76 when in position in the holes 194 and 196.

Figure 4:
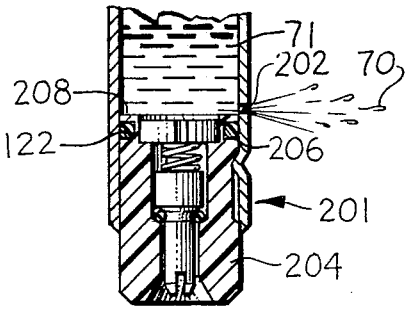
FIG. 4 is an enlarged detailed cross-sectional view of the lower portion of a slightly modified embodiment of the igniter shown in FIGS. 1, 2 and 3.

An alternate embodiment 201 is shown in FIG. 4 wherein a small orifice 202 is provided adjacent a modified lower plug 204, the modification being the positioning of the O-ring 122 in a groove 206 adjacent the top surface 208 thereof. When subjected to extreme overpressure, the plug 204 moves to force the O-ring 206 below the orifice 202 allowing the fuel 70 to escape.

Although in most instances, the length of the igniter 10 is related to its expected use time in such a way that a straight filler feeder tube 148 can be provided having a sufficient volume to provide the flame time desired, should more flame time be desired, a modified feeder tube 210 can be provided with more volume. The tube 210 shown is curled within the interior of the fuel chamber 126 so that an increased volume is provided. Up to a certain limit, the interior diameter of the central opening 152 in the feeder tube 148 also can be increased to provide this additional capacity.

Therefore, there has been shown and described a novel flame igniter which fulfills all of the objects and advantages sought therefore. Many changes, modifications, variations and other uses and applications of the subject invention will, however, become apparent to those skilled in the art after considering the foregoing specification together with the accompanying drawing. All such changes, modifications, variations and other uses and applications which do not depart from the spirit and scope of the invention are deemed to be covered by the invention which is limited only by the claims which follow.

What is claimed is:

1. A flame igniter including:

a chamber for containing liquified gaseous fuel having a top and a bottom;

gaseous fuel ignition means;

on/off fuel regulator means positioned closer to the top of said chamber than the bottom thereof; and a relatively long, thin, fuel feed tube having a fuel inlet end adjacent said bottom of said chamber and a fuel outlet end which extends to said on/off fuel regulator means, said chamber being defined by:

a body tube having top and bottom ends;

a bottom plug positioned in said bottom end of said body tube; and a top plug positioned in said top end of said body tube constructed from elastomeric material having a mechanical memory, said top plug having said on/off fuel regulator means positioned therein and defining a passageway for fuel from said feed tube to said on/off fuel regulator means, said on/off fuel regulator means including:

a valve needle having a threaded portion and a frustroconical needle portion;

a threaded portion of said top plug for threaded engagement with said threaded portion of said valve needle; and a cylindrical surface defined in said top plug positioned for engagement with said frustroconical needle portion which selectively allows and regulates fuel flow therepast.

2. The flame igniter as defined in claim 1 wherein said on/off fuel regulator means further includes a control knob which extends from said valve needle positioned for manual actuation thereof.

3. The flame igniter as defined in claim 2 further including a cap portion positioned above said top plug, said cap portion including a slot therein having first and second ends, said control knob extending through said slot and being restricted in movement by said first and second ends of said slot whereby when said knob is in contact with said first end, said flow of fuel is off and when said knob is in contact with said second end, said flow of fuel is maximum.

4. The flame igniter as defined in claim 3 wherein said gaseous fuel ignition means include:

a spark module body shaped for frictional engagement with said cap portion;

a spark wheel shaft mounted to said spark module body;

a spark wheel having a predetermined diameter mounted for rotation to said spark wheel shaft;

a pair of discs mounted for rotation to said spark wheel shaft with said shark wheel therebetween, said discs having a diameter similiar to said predetermined diameter of said spark wheel; and a spark producing material biased against said spark wheel so that the tangent therebetween faces a predetermined direction.

5. The flame igniter as defined in claim 4 wherein said top plug includes a burner tube having upper and lower portions, said upper portion of said burner being metallic and having a burner tip and an inner diameter which is small in relation to the length of said upper burner portion, said burner tip being positioned generally in alignment with the tangent between said spark producing material and said spark wheel.

6. The flame igniter as defined in claim 3 including releasable means, wherein said cap portion is connected to said top plug, and said top plug is connected to said body tube by said releasable means whereby said top plug can move out of said body tube in response to overpressure of fuel within said chamber to relieve the overpressure.

7. The flame igniter as defined in claim 6 wherein said body tube includes a mechanical indent, said body tube being connected to said top plug by friction and said mechanical indent.

8. The flame igniter as defined in claim 7 wherein said top plug includes:

an outer cylindrical surface having a longitudinal slot therein in which said mechanical indent is positioned; and an O-ring positioned thereabout for sealing contact with said body tube.

9. The flame igniter as defined in claim 1 wherein said relatively long, thin, fuel feed tube defines an inner fuel passageway having a cross-sectional diameter at least one hundred times smaller than its length.

10. The flame igniter as defined in claim 1 wherein said relatively long, thin, fuel feed tube is of a predetermined length which is longer than the distance between said top and said bottom of said chamber in which said fuel feed tube is positioned.

11. The flame igniter as defined in claim 10 wherein said relatively long, thin, fuel feed tube is curled within said chamber.

12. A flame igniter including:

a chamber for containing pressurized fuel having a top and a bottom, said chamber being defined by a body tube having top and bottom ends, and a top plug positioned in said top end of said body tube;

fuel ignition means;

on/off fuel regulator means; and fuel feed means having a fuel inlet end in communication with said fuel and a fuel outlet end which extends to said on/off fuel regulator means, said top plug being constructed from elastomeric material having a mechanical memory whereby said top plug defines a passageway for fuel from said fuel feed means to said on/off fuel regulator means, said on/off fuel regulator means including a valve needle having a threaded portion and a frustroconical needle portion, a threaded portion of said top plug for threaded engagement with said threaded portion of said valve needle, and a cylindrical surface defined in said top plug positioned for engagement with said frustroconical needle portion which selectively allows and regulates fuel flow therepast.

13. The flame igniter as defined in claim 12 wherein said on/off fuel regulator means further includes an control knob which extends from said valve needle positioned for manual actuation thereof.

14. The flame igniter as defined in claim 13 further including a cap portion positioned above said top plug, said cap portion including a slot therein having first and second ends, said control knob extending through said slot and being restricted in movement by said first and second ends of said slot whereby when said knob is in contact with said first end, said flow of fuel is off and when said knob is in contact with said second end, said flow of fuel is maximum.

15. The flame igniter as defined in claim 14 including releasable means, wherein said cap portion is connected to said top plug, and said top plug is connected to said body tube by said releasable means whereby said top plug can move out of said body tube in response to overpressure of fuel within said chamber to relieve the overpressure.

16. The flame igniter as defined in claim 14 wherein said body tube includes a mechanical indent, said body tube being connected to said top plug by friction and said mechanical indent, said cap portion being connected to said top plug whereby said top plug can move out of said body tube in response to overpressure of fuel within said chamber to relieve the overpressure.

17. The flame igniter as defined in claim 16 wherein said top plug includes:

an outer cylindrical surface having a longitudinal slot therein in which said mechanical indent is positioned; and an O-ring positioned thereabout for sealing contact with said body tube.

18. The flame igniter as defined in claim 12 wherein said body tube includes an inner cylindrical surface, a bottom plug, and a bottom end surface, said bottom plug including:

an outer cylindrical surface positioned in frictional engagement with said inner cylindrical surface of said body tube;

a bottom surface;

a top surface;

a radial groove a predetermined distance from said top surface in said outer cylindrical surface;

an O-ring in said radial groove positioned for sealing contact with said inner cylindrical surface of said body tube a predetermined distance from said bottom end surface of said body tube; and releasble means to retain said bottom plug in position in said body tube, whereby said bottom plug can move out of said body tube in response to overpressure of fuel within said chamber to relieve the overpressure.

19. The flame igniter as defined in claim 18 wherein said releasable means include:

a longitudinal slot in said outer cylindrical surface of said bottom plug of a predetermined length; and an indent in said body tube positioned in said longitudinal slot in said outer cylindrical surface of said bottom plug, said predetermined length of said longitudinal slot being greater than the distance said O-ring is normally positioned from said bottom end surface of said body tube.

20. The flame igniter as defined in claim 18 wherein said body tube includes a pressure relief hole therethrough positioned between said O-ring and said bottom end surface, said releasable means include:

a longitudinal slot in said outer cylindrical surface of said bottom plug of a predetermined length; and an indent in said body tube positioned in said longitudinal slot in said outer cylindrical surface of said bottom plug, said predetermined length of said longitudinal slot being greater than the distance said O-ring is normally positioned from said pressure relief hole of said body tube.

21. A flame igniter including:

a chamber for containing pressurized fuel having top and bottom ends, and a bottom plug positioned in said bottom end thereof;

fuel ignition means;

fuel flow control means; and fuel feed means having a fuel inlet end in communication with said fuel and a fuel outlet end which extends to said fuel flow control means, said chamber including an inner cylindrical surface and a bottom end surface, and said bottom plug including, an outer cylindrical surface positioned in frictional engagement with said inner cylindrical surface of said chamber, a bottom surface, a top surface, a radial groove a predetermined distance from said top surface in said outer cylindrical surface, an O-ring in said radial groove positioned for sealing contact with said inner cylindrical surface a predetermined distance from said bottom end surface, and releasable means to retain said bottom plug in position in said chamber, whereby said bottom plug can move out of said chamber in response to overpressure of fuel within said chamber to relieve the overpressure.

22. The flame igniter as defined in claim 21 wherein said releasable means include:

a longitudinal slot in said outer cylindrical surface of said bottom plug of a predetermined length; and an indent in said chamber positioned in said longitudinal slot in said outer cylindrical surface of said bottom plug, said predetermined length of said longitudinal slot being greater than the distance said O-ring is normally positioned from said bottom end surface of said chamber.

23. The flame igniter as defined in claim 21 wherein said chamber includes a pressure relief hole therethrough positioned between said O-ring and said bottom end surface, said releasable means include:

a longitudinal slot in said outer cylindrical surface of said bottom plug of a predetermined length; and an indent in said chamber positioned in said longitudinal slot in said outer cylindrical surface of said bottom plug, said predetermined length of said longitudinal slot being greater than the distance said O-ring is normally positioned from said pressure relief hole of said chamber.

24. The flame igniter as defined in claim 21 wherein at least a portion of the pressurized fuel is liquid, said fuel feed means fuel inlet end being positioned adjacent said top surface of said bottom plug, said fuel feed means extending to said fuel control means.

25. The flame igniter as defined in claim 24 wherein said fuel feed means includes a tubular member having an interior opening of a small enough cross-section that the surface tension of liquid fuel flowing therethrough can maintain a liquid column of fuel therein against the force of gravity.

26. A flame igniter including:

a chamber for containing liquified gaseous fuel having a top and a bottom;

gaseous fuel ignition means;

on/off fuel regulator means positioned closer to the top of said chamber than the bottom thereof; and a relatively long, thin, fuel feed tube having a fuel inlet end adjacent said bottom of said chamber and a fuel outlet end which extends to said on/off fuel regulator means, said chamber being defined by:

a body tube having top and bottom ends;

a bottom plug positioned in said bottom end of said body tube; and a top plug positioned in said top end of said body tube, said top plug having said on/off fuel regulator means positioned therein, said body tube including:

an inner cylindrical surface; and a bottom end surface, and said bottom plug including:

an outer cylindrical surface positioned in frictional engagement with said inner cylindrical surface of said body tube;

a bottom surface;

a top surface;

a radial groove a predetermined distance from said top surface in said outer cylindrical surface;

an O-ring in said radial groove positioned for sealing contact with said inner cylindrical surface of said body tube a predetermined distance from said bottom end surface of said body tube; and releasable means to retain said bottom plug in position in said body tube, whereby said bottom plug can move out of said body tube in response to overpressure of fuel within said chamber to relieve the overpressure.

27. A flame igniter including:

a chamber for containing liquified gaseous fuel having a top and a bottom;

gaseous fuel ignition means;

on/off fuel regulator means positioned closer to the top of said chamber than the bottom thereof; and a relatively long, thin, fuel feed tube having a fuel inlet end adjacent said bottom of said chamber and a fuel outlet end which extends to said on/off fuel regulator means, said chamber being defined by:

a body tube having top and bottom ends;

a bottom plug positioned in said bottom end of said body tube; and a top plug positioned in said top end of said body tube, said top plug having said on/off fuel regulator means positioned therein, said bottom plug including:

a bottom surface;

a top surface;

an inner passageway from said top surface to said bottom surface being defined by a first frustoconical surface which slopes inwardly and away from said bottom surface, a first cylindrical surface which extends from said first frustroconical surface, a second frustroconical surface which slopes outwardly and away from said first cylindrical surface, a second cylindrical surface having a diameter greater than the diameter of said first cylindrical surface, a radial surface which extends outwardly from said second cylindrical surface, and a third cylindrical surface having a diameter greater than the diameter of said second cylindrical surface which extends from said radial surface to said top surface of said bottom plug;

a nipple member slidably mounted in said inner passageway, said nipple member having a radial groove thereabout and an O-ring positioned in said radial groove for releasable sealing engagement with said second frustroconical surface; and means to bias said nipple member toward said bottom surface.

28. The flame igniter as defined in claim 26 wherein said releasable means include:

a longitudinal slot in said outer cylindrical surface of said bottom plug of a predetermined length; and an indent in said body tube positioned in said longitudinal slot in said outer cylindrical surface of said bottom plug, said predetermined length of said longitudinal slot being greater than the distance said O-ring is normally positioned from said bottom end surface of said body tube.

29. The flame igniter as defined in claim 26 wherein said body tube includes a pressure relief hole therethrough positioned between said O-ring and said bottom end surface, said releasable means include:

a longitudinal slot in said outer cylindrical surface of said bottom plug of a predetermined length; and an indent in said body tube positioned in said longitudinal slot in said outer cylindrical surface of said bottom plug, said predetermined length of said longitudinal slot being greater than the distance said O-ring is normally positioned from said pressure relief hole of said body tube.

30. The flame igniter as defined in claim 27 wherein said nipple member includes:

a radial lower tip surface;

a frustroconical surface which extends outwardly and away from said radial lower tip surface;

a cylindrical surface having a smaller diameter than the inner diameter of said first cylindrical surface of said inner passageway extending from said frustroconical surface of said nipple member away from said radial lower tip surface; and a transverse slot extending through said radial lower tip surface, said frustroconical surface of said nipple member, and a portion of said cylindrical surface of said nipple member.

* * * * *